US008511380B2

(12) United States Patent
Guignard et al.

(10) Patent No.: US 8,511,380 B2
(45) Date of Patent: Aug. 20, 2013

(54) MULTI-ZONE GRAVEL PACK SYSTEM WITH PIPE COUPLING AND INTEGRATED VALVE

(75) Inventors: Thibaut Guignard, Houston, TX (US); Jesus Chavez, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 154 days.

(21) Appl. No.: 12/246,070

(22) Filed: Oct. 6, 2008

(65) Prior Publication Data

US 2009/0095471 A1 Apr. 16, 2009

Related U.S. Application Data

(60) Provisional application No. 60/978,983, filed on Oct. 10, 2007.

(51) Int. Cl.
*E21B 43/04* (2006.01)
*E21B 43/08* (2006.01)

(52) U.S. Cl.
USPC ..... 166/278; 166/227; 166/51

(58) Field of Classification Search
USPC ..... 166/51, 278, 227–236
See application file for complete search history.

(56) References Cited

U.S. PATENT DOCUMENTS 3,741,300 A 6/1973 Wolff et al.
4,401,158 A * 8/1983 Spencer et al. ..... 166/51
4,424,864 A * 1/1984 Logan ..... 166/278
4,510,996 A 4/1985 Hardin
4,541,484 A * 9/1985 Salerni et al. ..... 166/278
4,754,807 A * 7/1988 Lange ..... 166/236
4,793,411 A * 12/1988 Zunkel ..... 166/98
4,856,591 A 8/1989 Donovan
5,069,280 A * 12/1991 McKee et al. ..... 166/278
5,318,119 A * 6/1994 Lowry et al. ..... 166/228
5,337,808 A 8/1994 Graham
5,507,345 A * 4/1996 Wehunt et al. ..... 166/285

(Continued)

FOREIGN PATENT DOCUMENTS

EP 1225302 A1 7/2002
WO 9628636 A1 9/1996
WO 0142620 A1 6/2001

OTHER PUBLICATIONS

Corrected drawings filed Feb. 13, 2006 from U.S. Appl. No. 10/347,973, published as US 2004/0140089 to Gunneroed.*

(Continued)

*Primary Examiner* — Jennifer H Gay
*Assistant Examiner* — Blake Michener
(74) *Attorney, Agent, or Firm* — David G. Matthews; Tim Curington

(57) ABSTRACT

Apparatus having a first outer tubular member and a first inner tubular member. The first outer tubular member and the first inner tubular member can define a first space therebetween. The first inner tubular member can have a first internal bore. The apparatus can further include a second outer tubular member and a second inner tubular member. The second outer tubular member and the second inner tubular member can define a second space therebetween. The second inner tubular member can have a second internal bore. A first coupling flowpath can be positioned between the first and second spaces. A second coupling flowpath can be positioned between the first and second internal bores. A selectively closeable flowpath can be positioned between the first coupling flowpath and the second coupling flowpath.

22 Claims, 7 Drawing Sheets

(56) References Cited

U.S. PATENT DOCUMENTS

| | | | | |
|---|---|---|---|---|
| 5,551,512 | A * | 9/1996 | Smith | 166/212 |
| 5,577,559 | A | 11/1996 | Voll et al. | |
| 5,579,844 | A | 12/1996 | Rebardi | |
| 5,597,040 | A * | 1/1997 | Stout et al. | 166/51 |
| 5,609,204 | A * | 3/1997 | Rebardi et al. | 166/51 |
| 5,611,399 | A * | 3/1997 | Richard et al. | 166/230 |
| 5,690,175 | A | 11/1997 | Jones | |
| 5,787,980 | A * | 8/1998 | Sparlin et al. | 166/231 |
| 5,865,251 | A * | 2/1999 | Rebardi et al. | 166/278 |
| 5,868,200 | A * | 2/1999 | Bryant et al. | 166/51 |
| 5,921,318 | A * | 7/1999 | Ross | 166/250.17 |
| 5,988,285 | A | 11/1999 | Tucker et al. | |
| 6,216,785 | B1 | 4/2001 | Achee | |
| 6,220,353 | B1 | 4/2001 | Foster | |
| 6,220,357 | B1 | 4/2001 | Carmichael et al. | |
| 6,230,803 | B1 * | 5/2001 | Morton et al. | 166/278 |
| 6,302,216 | B1 | 10/2001 | Patel | |
| 6,343,651 | B1 | 2/2002 | Bixenman | |
| 6,397,949 | B1 | 6/2002 | Walker et al. | |
| 6,405,800 | B1 | 6/2002 | Walker | |
| 6,446,729 | B1 | 9/2002 | Bixenman | |
| 6,464,006 | B2 * | 10/2002 | Womble | 166/276 |
| 6,464,261 | B1 | 10/2002 | Dybevik | |
| 6,488,082 | B2 | 12/2002 | Echols et al. | |
| 6,494,256 | B1 * | 12/2002 | Achee et al. | 166/51 |
| 6,513,599 | B1 | 2/2003 | Bixenman | |
| 6,516,881 | B2 * | 2/2003 | Hailey, Jr. | 166/278 |
| 6,571,875 | B2 | 6/2003 | Bissonnette | |
| 6,575,243 | B2 | 6/2003 | Pabst | |
| 6,675,893 | B2 * | 1/2004 | Lund | 166/278 |
| 6,719,051 | B2 | 4/2004 | Hailey, Jr. et al. | |
| 6,722,440 | B2 | 4/2004 | Turner et al. | |
| 6,725,929 | B2 | 4/2004 | Bissonnette | |
| 6,745,834 | B2 | 6/2004 | Davis | |
| 6,766,857 | B2 | 7/2004 | Bixenman | |
| 6,857,475 | B2 | 2/2005 | Johnson | |
| 6,932,156 | B2 | 8/2005 | Bayne et al. | |
| 6,983,795 | B2 * | 1/2006 | Zuklic et al. | 166/51 |
| 7,066,264 | B2 | 6/2006 | Bissonnette | |
| 7,096,945 | B2 | 8/2006 | Richards et al. | |
| 7,127,824 | B2 | 10/2006 | Mies | |
| 7,201,232 | B2 | 4/2007 | Turner et al. | |
| 7,222,676 | B2 | 5/2007 | Patel | |
| 7,225,523 | B2 * | 6/2007 | Metcalfe | 29/507 |
| 7,322,422 | B2 | 1/2008 | Patel | |
| 7,461,695 | B2 | 12/2008 | Boney | |
| 2003/0000700 | A1 * | 1/2003 | Hailey, Jr. | 166/278 |
| 2003/0047311 | A1 | 3/2003 | Echols et al. | |
| 2003/0089495 | A1 * | 5/2003 | Bixenman | 166/265 |
| 2004/0094309 | A1 * | 5/2004 | Maguire | 166/381 |
| 2004/0140089 | A1 * | 7/2004 | Gunneroed | 166/228 |
| 2004/0262011 | A1 | 12/2004 | Huckabee et al. | |
| 2007/0039741 | A1 * | 2/2007 | Hailey, Jr. | 166/376 |
| 2007/0084605 | A1 | 4/2007 | Walker et al. | |
| 2007/0102153 | A1 | 5/2007 | Bixenman | |
| 2007/0114020 | A1 * | 5/2007 | Brekke | 166/236 |
| 2007/0227727 | A1 | 10/2007 | Patel | |
| 2007/0240881 | A1 | 10/2007 | Whitsitt | |
| 2007/0246212 | A1 * | 10/2007 | Richards | 166/227 |
| 2007/0251690 | A1 | 11/2007 | Whitsitt | |
| 2008/0142218 | A1 * | 6/2008 | Rytlewski et al. | 166/278 |
| 2008/0283252 | A1 * | 11/2008 | Guignard et al. | 166/381 |
| 2009/0000787 | A1 * | 1/2009 | Hill et al. | 166/344 |
| 2009/0095471 | A1 | 4/2009 | Guignard | |
| 2009/0173498 | A1 * | 7/2009 | Gaudette et al. | 166/278 |

OTHER PUBLICATIONS

Entries for "screen" and "blank pipe" from the Schlumberger Oilfield Glossary, accessed Jan. 17, 2013 via www.glossary.oilfield.slb.com.*

Waters, F., Singh, P., Baker, C., Van Wulfften Palthe, P., and Parlar, M., "A Novel Techique for Single-Selective Sand Control Completions Allows Perforating and Gravel Packing of Two Zones with Zonal Isolation in One Trip: A Case History from Trinidad". SPE 56668, 1999 SPE Annual Technical Conference and Exhibition, Oct. 1999; pp. 1-7.*

Cole, B., Franklin, B. M., Cody, R., and Littleton, R., "The Viability of Single-Trip Sand-Control Completions in Deep Water—A Case History", SPE 97147, 2005 SPE Annual Technical Conference and Exhibition, Oct. 2005; pp. 1-8.*

EP Supplementary Search Report, Application No. EP08838453, Nov. 22, 2012, The Hague.

Brannon, D. H., Harrison, D. T., and Van Sickle, E. W., "Gravel Packing Dual Zones in One Trip Reduces Offshore Completion Time", World Oil, Sep. 1991, vol. 212(9): pp. 103-107.

Waters, F., Singh, P., Baker, C., Van Wulfften Palthe, P., and Parlar, M., "A Novel Technique for Single-Selective Sand Control Completions Allows Perforating and Gravel Packing of Two Zones with Zonal Isolation in One Trip: A Case History from Trinidad", SPE 56668, 1999 SPE Annual Technical Conference and Exhibition, Oct. 1999; pp. 1-7.

Rivas, L. F., Zeiler, C. E., Graff, B., Ogbunuju E., and Parlar, M., "A Multi-Zone Single-Trip Gravel Packing and Production Technique Reduces Completion Costs by 60% Compared to Conventional Water-Packing in a Single-Selective Completion in the Gulf of Mexico", SPE 58776, 2000 SPE International Symposium on Formation Damage Control, Feb. 2000; pp. 1-6.

Marshall, J., Obianwu, C., Tibbles, R., and Vargas, W., "A Unique Cost Effective Technique for One Trip Selective Gravel Packing Over Multiple Zones: Dacion Field Case Study" IADC/SPE 59168, 2000 IADC/SPE Drilling Conference, Feb. 2000; pp. 1-11.

Von Flatern, R., "Single-Trip Showdown", Oilfield Engineer, Mar. 2004: pp. 24-28.

Cole, B., Franklin, B. M., Cody, R., and Littleton, R., "The Viability of Single-Trip Sand-Control Completions in Deep Water—A Case History", SPE 97147, 2005 SPE Annual Technical Conference and Exhibition, Oct. 2005: pp. 1-8.

* cited by examiner

MULTI-ZONE GRAVEL PACK SYSTEM WITH PIPE COUPLING AND INTEGRATED VALVE

CROSS-REFERENCE TO RELATED APPLICATIONS

This application claims priority to U.S. Provisional Patent Application having Ser. No. 60/978,983, filed on Oct. 10, 2007, which is incorporated herein by reference.

BACKGROUND

Hydrocarbon producing formations typically have sand commingled with the hydrocarbons to be produced. For various reasons, it is not desirable to produce the commingled sand to the earth's surface. Thus, sand control completion techniques are used to prevent the production of sand.

Gravel packing is one method for controlling sand production. Although there are variations, gravel packing usually involves placing a sand screen around the section of the production string containing the production inlets. This section of the production string is aligned with perforations. Gravel slurry, which is typically gravel particulates carried in a viscous transport fluid, is pumped through the tubing into the formation and the annulus between the sand screen and the casing or between the sand screen and the open hole. The deposited gravel holds the sand in place preventing the sand from flowing to the production tubing while allowing the production fluids to be produced therethrough.

In multi-zone wells or in a well having multiple flow sections, flow control devices have been used to control fluid flow through orifices formed between the tubing bore and an annulus between the tubing and casing. However, if sand face completion equipment including gravel packing is installed, then the annulus is typically filled, which makes it difficult to position such flow control devices in the proximity of sand control equipment. Accordingly, the formation fluid must first flow generally radially through the sand control device before flowing to the flow control device. One option is to install the flow control device inside a tubing bore in the proximity of the production zone. However, this reduces the available flow area for production flow.

Three-way sub systems with sliding sleeves inside an internal isolation string have also been used for zonal isolation. A screen wrapped sliding sleeve is also a common system. For example, U.S. Pat. No. 3,741,300 discloses a sliding sleeve within a screen assembly. However, the '300 patent describes a 3-way sub system and it is specifically intended for stand alone screen applications (no pumping).

U.S. Pat. No. 5,337,808 discloses an apparatus where the screen wrapping is placed directly over and around the flow control device. U.S. Pat. No. 6,220,357 discloses a similar apparatus.

U.S. Pat. No. 5,609,204 and U.S. Pat. No. 5,579,844 disclose an apparatus having sliding sleeves inside sand control screens in combination with components for supporting gravel packing operations such as polished bore receptacles and port closure sleeves.

U.S. Pat. No. 5,865,251 discloses an isolation valve "adjacent" or "interior" of the screen assembly which covers the apertures of the valve.

U.S. Pat. No. 6,405,800 discloses an isolation valve that is positioned in the screen base pipe underneath the screen jacket.

U.S. Pat. No. 6,343,651 and U.S. Pat. No. 6,446,729 disclose a flow control valve that is coupled to a screen assembly. It is not surrounded by and is offset from the screen wrapping.

The valve is in fact not integral to the screen assembly but an added component which is hydraulically coupled to the screen and base pipe annulus to control flow into the main bore.

U.S. Pat. No. 6,464,006 discloses an apparatus having flow screens with flow closure members. The figures presented in U.S. Pat. No. 6,464,006 illustrate a three-way sub system, but both ends of the isolation pipe are shown affixed to the screen assembly.

U.S. Pat. No. 6,719,051 and U.S. Pat. No. 7,096,945 disclose a screen assembly with openings in the base pipe and a valve associated with the openings in the base pipe to control flow through the openings.

U.S. Publication No. 2007/0084605 discloses a screen assembly with at least one production screen valve.

There is still a need for improved flow control devices that provide incremental choking of the flow and that may be used in sand control completion equipment. There is also a need for a coupling tool that supports a flowpath between two screens without the use of an isolation string.

SUMMARY

An apparatus including a pipe coupling and integrated valve and method of using the same is disclosed. The apparatus can include a first outer tubular member and a first inner tubular member. The first outer tubular member and the first inner tubular member can define a first space therebetween. The first inner tubular member can have a first internal bore. The system can also include a second outer tubular member and a second inner tubular member. The second outer tubular member and the second inner tubular member can define a second space therebetween. The second inner tubular member can have a second internal bore formed therethrough. A first coupling flowpath can be positioned between the first and second spaces. A second coupling flowpath can be positioned between the first and second internal bores. A selectively closeable flowpath can be positioned between the first coupling flowpath and the second coupling flowpath.

One or more embodiments of the method of using the multi-zone gravel pack system with pipe coupling an integrated valve can include conveying a completion string downhole. An annulus can be formed between the completion string and a wellbore. The completion string can include at least two sand completion systems, a communication port positioned adjacent to each sand completion system, and a position indicator positioned adjacent to each communication port. Each sand completion system can include one or more apparatuses. The method can further include, positioning one of the sand completion systems adjacent to a lower hydrocarbon bearing zone, and the other sand completion system adjacent to an upper hydrocarbon bearing zone. Communication between the annulus adjacent the upper hydrocarbon bearing zone and the internal bores of the adjacent sand completion system can be prevented, and communication between the annulus adjacent the lower hydrocarbon bearing zone and the internal bores of the adjacent sand completion system can be allowed. Gravel can be provided to a portion of the annulus adjacent to the lower hydrocarbon bearing zone.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

A detailed description of the one or more embodiments, briefly summarized above, is provided below. As used herein, the terms "up" and "down"; "upper" and "lower"; "upwardly" and "downwardly"; "upstream" and "downstream"; and other like terms are merely used for convenience to describe spatial orientations or spatial relationships relative to one another in a vertical wellbore. However, when applied to equipment and methods for use in deviated or horizontal wellbores, it is understood to those of ordinary skill in the art that such terms are intended to refer to a left to right, right to left, or other spatial relationship as appropriate.

Figure 1:
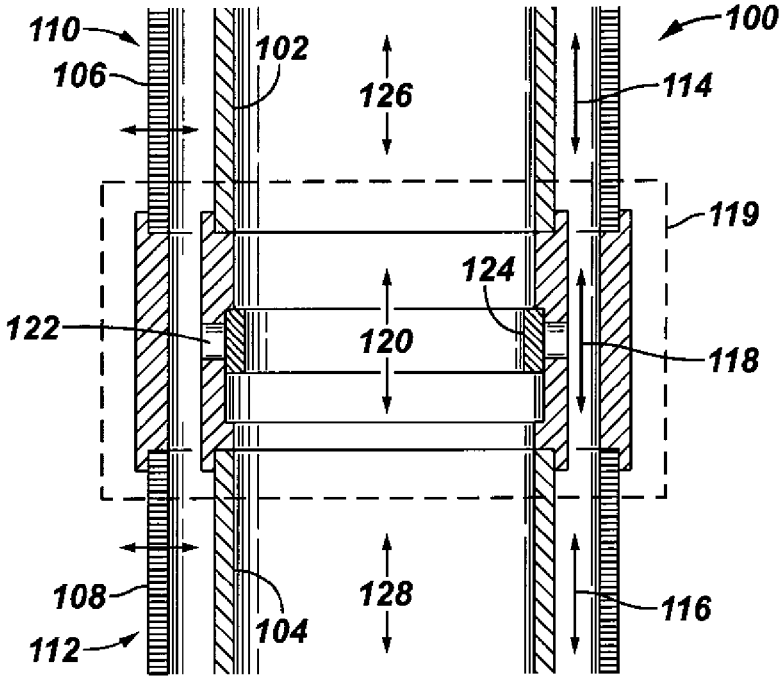
FIG. 1 depicts an illustrative sand completion system in a closed position, according to one or more embodiments described.

FIG. 1 depicts an illustrative sand completion system 100 in a closed position, according to one or more embodiments. The sand completion system 100 can include two or more screen assemblies 110, 112 having a coupling tool 119 disposed therebetween. Each screen assembly 110, 112 can include an outer tubular member 106, 108 disposed about a body or mandrel ("inner tubular member") 102, 104. For example the first assembly 110 can be the first outer tubular member 106 about the first inner tubular member 102, and the second assembly 112 can include the second outer tubular member 108 about the second inner tubular member 104.

The outer tubular members 106, 108 can include a screen or particulate restricting member. The screen or particulate restricting member can be wire wrapped screens or any other known screen. For example, one or more portions of the outer tubular member can be constituted by wire wrap screen.

Each inner tubular member 102, 104 can be base pipe, production tubing, or any other common downhole tubular member. In one or more embodiments, the body 102 ("first inner tubular member 102") can have an inner flowpath or internal bore 126 formed therethrough, and the second body 104 ("second inner tubular member 104") can have an inner flowpath or internal bore 128 formed therethrough.

A space or gap 114, 116 is formed between an outer diameter of each inner tubular member 102, 104 and the surrounding screen 106, 108. Each space or gap 114, 116 defines an outer flowpath about its respective inner tubular member 102, 104. For example, a first flowpath or first space 114 is formed between the first inner tubular member 102 and the first screen 106. The second flowpath or second space 116 is formed between the second inner tubular member 104 and the second screen 108.

The coupling tool 119 can include a first coupling flowpath 118, a second coupling flowpath 120, and a third coupling flowpath 122 formed therethrough. The first coupling flowpath 118 can be in fluid communication, and thus "couple" the first flowpath or space 114 to the second flowpath or space 116. The second coupling flowpath 120 can be in fluid communication, and thus "couple" the first inner flowpath 126 to the second inner flowpath 128. The third coupling flowpath 122 can be in fluid communication, and thus "couple" the first coupling flowpath 118 and the second coupling flowpath 120.

The coupling tool 119 can further include a flow control device 124. The flow control device 124 allows the outer flowpaths 114, 116 to be selectively communicated with the inner flowpaths 126, 128. In one or more embodiment, the flow control device 124 can be integrated into the coupling tool 119. In one or more embodiments, the flow control device 124 can be a stand alone component that can be attached to the coupling tool 119.

In one or more embodiments, the flow control device 124 can be a sliding sleeve. An illustrative sliding sleeve can simply be a tubular member disposed within the annulus of the coupling tool 119. In one or more embodiments, the flow control device 124 can be a sliding sleeve having one or more apertures or holes formed therethrough. In one or more embodiments, the flow control device 124 can be a remotely operated valve, or any other downhole flow control device. An illustrative flow control device 124 is described in U.S. Pat. No. 6,446,729.

The use of the flow control device 124 with the coupling tool 119 can allow for flexibility in the design of the flow control device 124 without affecting the manufacturing and design of the sand screen assemblies 110, 112. Furthermore, by allowing the complexity of the flow control device 124 to be varied independent of the design of the sand screen assemblies 110, 112, various levels of modularity for the sand completion system 100 can be obtained.

When the flow control device 124 is in a closed position, the first coupling flowpath 118 is not in communication with the second coupling flowpath 120; however, the first flowpath or space 114 is in communication with the second flowpath or space 116, and the first inner flowpath 126 is in communication with the second inner flowpath 128. Furthermore, the flowpaths 114, 116, 118 can be in communication with the exterior of the screen assemblies 110, 112. However, the flowpaths 126, 128, 120 are prevented from communicating with the exterior of the sand screen assemblies 110, 112.

Figure 2:
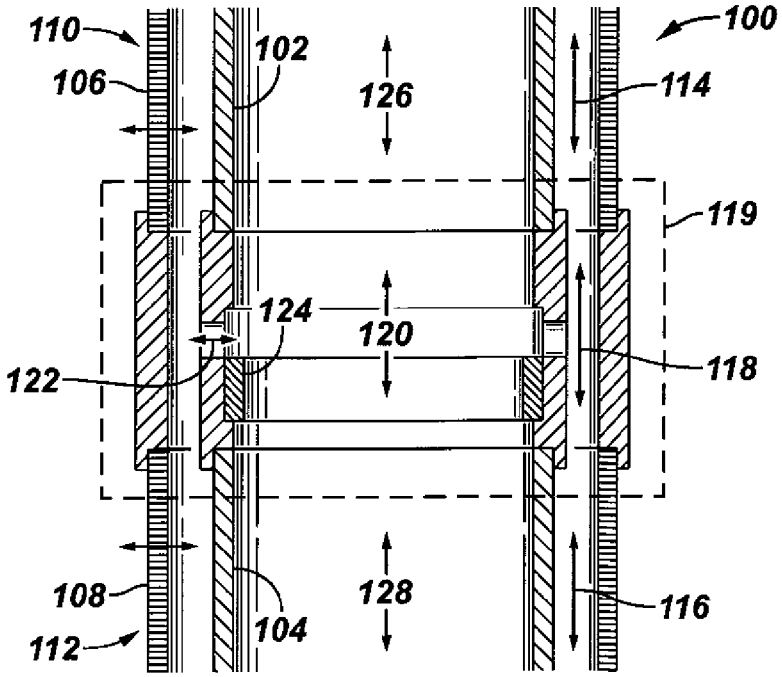
FIG. 2 depicts the illustrative sand completion system of FIG. 1 in an open position, according to one or more embodiments described.

In the open position, the first coupling flowpath 118 is in communication with the second coupling flowpath 120, and the third coupling flowpath 122, as depicted in FIG. 2. When the flow control device 124 is in an open position, each of the flowpaths 114, 116, 126, 128, 118, 122, 120 is in communication with the exterior of the screen assemblies 110, 112. Therefore, the inner flowpaths 126, 128 are in communication with the exterior of the sand screen assemblies 110, 112 when the second coupling flowpath 120 is in communication with the first coupling flowpath 118.

Figure 3:
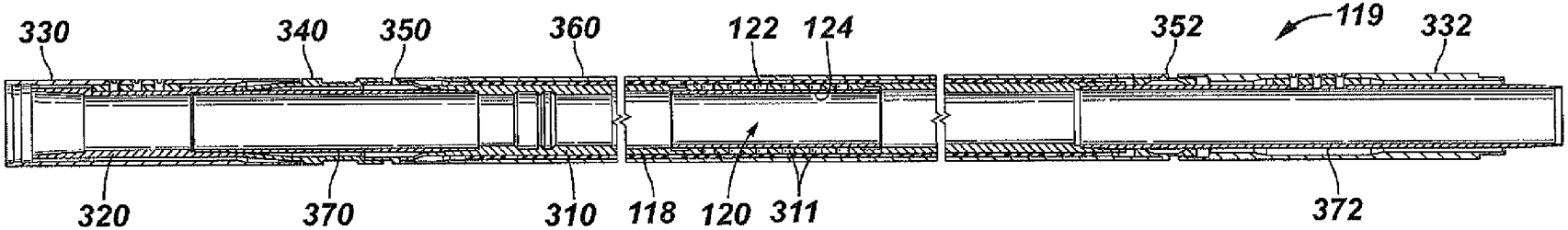
FIG. 3 depicts an illustrative coupling tool, according to one or more embodiments described.

FIG. 3 depicts an illustrative coupling tool 119, according to one or more embodiments. The coupling tool 119 can include one or more housings 310, one or more shrouds 360, one or more flow control device 124, one or more first coupling flowpaths 118, one or more second coupling flowpaths 120, one or more pipe couplings 320, one or more torque transfer shrouds (two are shown 330, 332), one or more load inserts 340, one or more end rings (two are shown 350, 352), one or more pipe joints (two are shown 370, 372), and one or more third coupling flowpaths 122.

The length of the coupling tool 119 can be determined by the size of the flow control device 124. The shroud 360 can be placed at least partially about the housing 310, and pipe joints 370, 372. The first coupling flowpath 118 can be formed between the shroud 360 and the housing 310 and pipe joints 370, 372. In one or more embodiments, the shroud 360 can be a solid tubular shroud. The end rings 350, 352 can be positioned adjacent to the shroud 360. Since the length of the coupling tool 119 can be determined by the length of the flow control device 124, a solid shroud would create a section of a sand completion system 100, without screens that may be longer than encountered in typical applications. This could have an adverse effect on the placement of the sand control treatment. Such effects can be poor packing around the coupling area and premature bridging at the top of the coupling area. In this situation, the shroud can include slotted openings (not shown). For example, a slotted liner can be used. The slotted liner can allow for leak off during gravel placement. Therefore, in one or more embodiments, the entire shroud or a portion of the shroud can include the slotted openings.

The flow control device 124 can be disposed within the housing 310. The housing 310 can be positioned between the pipe joints 370, 372. The housing can have a plurality of apertures 311 or holes formed therethrough. The apertures 311 can allow communication between the second coupling flowpath 120 and the third coupling flowpath 122. The apertures or holes can be selectively opened and closed by the flow control device 124. For example, if the flow control device 124 is a sliding sleeve the sliding sleeve can be configured to selectively prevent flow through the apertures 311, thus preventing communication between the third coupling flowpath 122 and the second coupling flowpath 120.

The pipe joints can be tubular members configured to attach or otherwise engage inner tubular members of a double wall tubular assembly, such as screen assemblies 110, 112. A pipe coupling 320 can be positioned adjacent to at least one of the pipe joints 370, 372, such as "upper" pipe joint 370, as depicted in FIG. 3.

The torque shrouds 330, 332 can be positioned about a portion of the pipe joint 370, 372, and the pipe coupling 320. The torque shrouds can be production tubing or other known downhole tubing. The torque shrouds 330, 332 can allow for the transfer of torque. The "upper" torque shroud 330 can be floating allowing the "upper" torque shroud 330 to move. The "lower" torque shroud 332 can be fixed to the pipe joint 372.

A load insert 340 can be positioned adjacent to the "upper" torque shroud 330. The load insert 340 can interface with a screen table/plate known in the industry and temporarily support the hanging weight of the completion during make up operations at surface.

Figure 4:
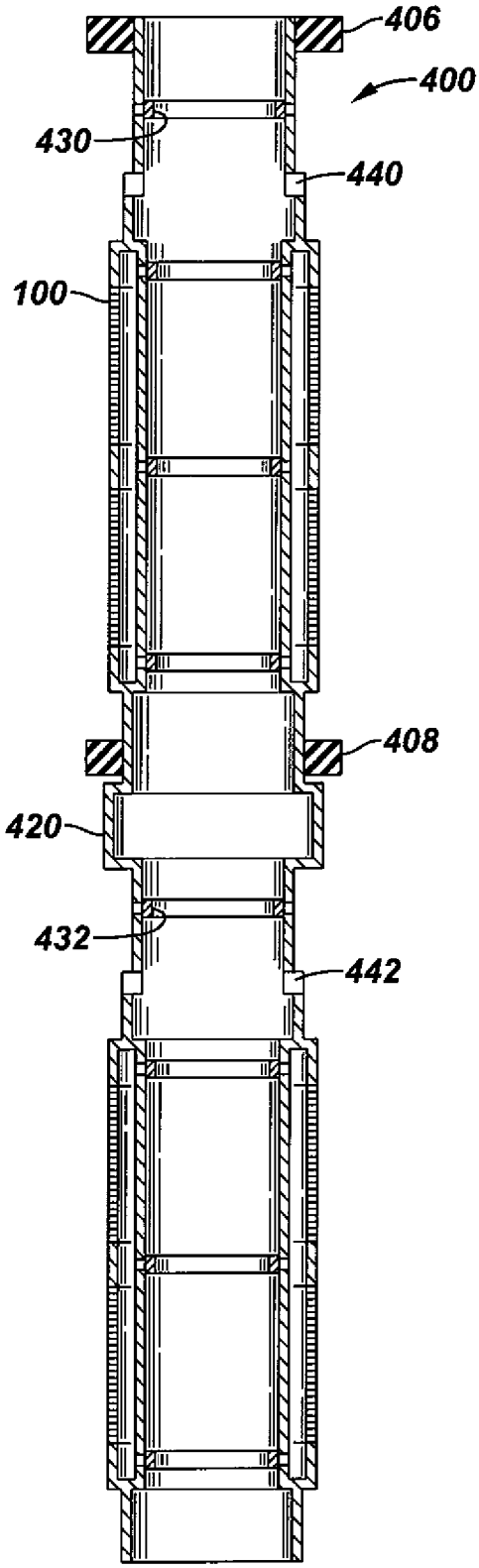
FIG. 4 depicts an illustrative view of one or more sand completion systems integrated into a completion string, according to one or more embodiments described.

FIG. 4 depicts an illustrative view of one or more sand completion systems 100 integrated into a completion string 400, according to one or more embodiments. The completion string 400 can include two or more sand completion systems 100 (two are shown), two or more isolation packers (two are shown 406, 408), one or more internal upsets 420, two or more port closure sleeves (two are shown 430, 432), and two or more position indicators (two are shown 440, 442). The completion string 400 can include any type of well treatment strings, including well treatment strings that are used during subterranean formation fracturing, completion, or other operations. A suitable completion string 400 can be used for gravel packing operations, chemical treatment operations, and/or other common workover operations.

The isolation packers can be used to isolate hydrocarbon bearing zones (not shown) located within a producing formation (not shown). For example, the first isolation packer can be disposed adjacent to an upper hydrocarbon bearing zone, the second isolation packer can be disposed adjacent to a lower hydrocarbon bearing zone, and a third isolation packer (not shown) can be disposed below the lower hydrocarbon bearing zone. In one or more embodiments, the third packer can be installed in a wellbore (not shown) prior to the installation of the completion 400 and the completion 400 can be configured to attach to or otherwise engage the third isolation packer, or in the alternative the isolation packer can be integrated with the completion 400. The isolation packers 406, 408 can be compression or cup packers, inflatable packers, "control line bypass" packers, polished bore retrievable packers, any other common downhole sealing mechanism, or combinations thereof. The isolation packers 406, 408 can be set in the wellbore by the use of mechanical means or by any other known method.

The internal upset 420 can be disposed adjacent to the second packer 408. The internal upset 420 can allow for a more direct reverse flow. The internal upset 420 can be an internal upset commonly known in the art.

The first port closure sleeve 430 can be disposed adjacent to the first packer 406. The second port closure sleeve 432 can be disposed adjacent to the internal upset 420. The port closure sleeves can be engaged by a service tool (not shown), and can allow the service tool to communicate with the exterior of the completion 400. The port closure sleeves 430, 432 can be any port closure sleeve commonly known in the art. An illustrative communication port closure sleeve is described in more detail in U.S. Pat. No. 7,066,264. The port closure sleeves 430, 432 can have polished bore receptacles (not shown).

The position indicators 440, 442 can be disposed adjacent to the port closure sleeves 430, 432. The position indicators 440, 442 can be used to position a service tool for engagement with the port closure sleeves 430, 432. Each position indicators 440, 442 can be a "Go/no go" collar, for example. A suitable indicator is described in U.S. Pat. No. 7,066,264. Of course, the position indicators 440, 442 can be any other type of position indicator known in the art.

Additional coupling tools 119 can be positioned at each end of each sand completion system 100. In one or more embodiments, one or more of the coupling tools 119 of one or more of the sand completion systems 100 can be modified by removing the third coupling flowpath 122, and the flow control device 124. Such modified coupling tool (not shown) could provide the first coupling flowpath 118 and the second coupling flowpath 120. However, the first coupling flowpath 118 would not be in communication with the second coupling flowpath 120. In one or more embodiments, such modified coupling tool could be used as a contingency perforating target. For example, a perforating gun can be run into the wellbore, located adjacent the modified coupling tool and perforate holes into the modified coupling tool to allow for communication between the completion bore and the annulus.

Figure 5:
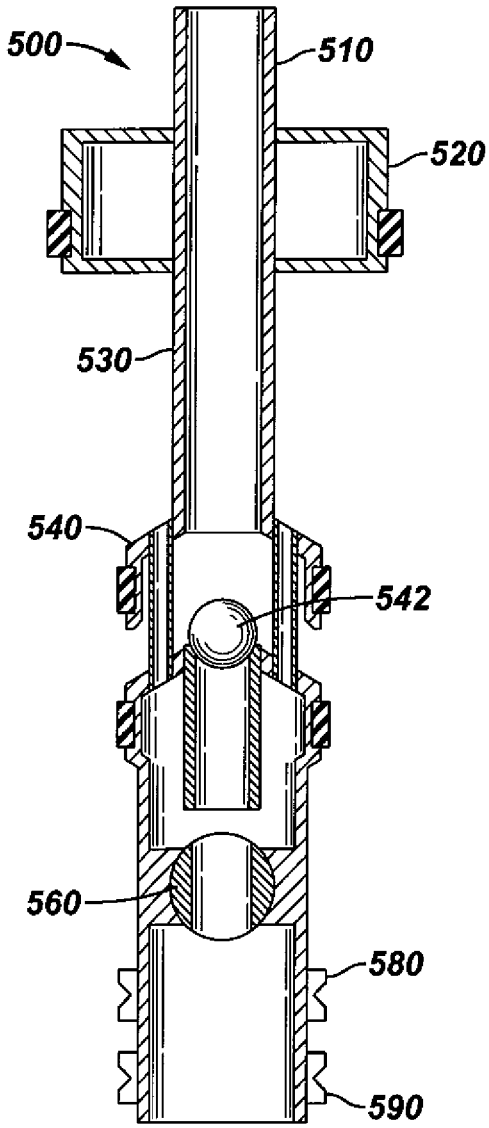
FIG. 5 depicts an illustrative service string for performing multi-zone gravel pack operations, according to one or more embodiments described.

FIG. 5 depicts a service string 500 for performing multizone gravel pack operations, according to one or more embodiments. The service string 500 can include one or more tubular members 510, one or more gravel pack setting modules 520, one or more spacer strings 530, one or more cross over port bodies 540, one or more reversing valves 560, one or more shifting tools 580, and one or more sliding sleeve collets 590.

The tubular member 510 can be production tubing or other tubing commonly used downhole. The tubular member 510 can have a length sufficient to run from the surface down to the top of the completion 400.

The gravel pack setting module 520 can be engaged or otherwise supported by the tubular member 510. The gravel pack setting module 520 can be any gravel pack setting module known in the art. The gravel pack setting module 520 can be configured to engage or otherwise attach to the first packer 406. The gravel pack setting module 520 can be used to set the top isolation packer, such as first packer 406.

The spacer string 530 can be positioned adjacent to the packer setting module 520. The spacer string 530 can be a blank pipe or other tubing member. The spacer string 530 can have a length long enough to extend the shifting tool 580 bellow the lowermost flow control device 124 to be operated. For example, the spacer string 530 can be long enough to extend the shifting tool 580 below the flow control device 124 of the lowermost coupling tool 119 of a "lower" sand completion system 100.

The cross over port body 540 can be disposed on the spacer string 530 above the shifting tool 580. The cross over port body 540 can be any cross over port body known in the art. In one or more embodiments, the cross over port body 540 can be equipped with a shear down ball seat 542. The crossover port body 540 can sealably interface with the completion bore 405 at various locations to support multi-zone gravel pack operations. The sealable interface can be achieved using methods commonly known in the art. For example, the sealable interaction can either be by seals (not shown), such as bonded seals or cup seals, on the outer diameter of the cross over port body 540 and polished bore receptacles (not shown) integrated into the completion or the inverse using internal seals (not shown) integrated with the completion 400 and polished surfaces (not shown) on the outer diameter of the cross over port body 540.

The reversing valve 560 can be positioned below the crossover port body 540. The reversing valve 560 can restrict or prevent flow downhole past the service string 500. In one or more embodiments, it would be desirable that the reversing valve 560 operate without impairing movements of the service tool 500, due to hydraulic locking issues. One way to provide such functionality is to use a full bore set down module or equivalent technology with a modified valve that has a small hole through it to allow for minimal leak through while supporting greater reverse out pressures/rates. In one or more embodiments, the reversing valve 560 can have an anti-swab feature. The reversing valve 560 can be any valve known in the art.

The shifting tool 580 can be positioned below the reversing valve 560. The shifting tool 580 can be adapted to at least actuate the flow control devices 124 of the sand completion assemblies 100. In one or more embodiments, the shifting tool 580 can actuate the flow control devices 124 and the port closure sleeves 430, 432. The shifting tool 580 can be a collet, a magnetic actuator, another common down hole shifting tool, or combinations thereof.

The sliding sleeve shifting tool 590 can be disposed below the shifting tool 580. The sliding sleeve shifting tool 590 can be configured to actuate at least the port closure sleeves 430, 432. In one or more embodiments, the sliding sleeve shifting tool 590 can be configured to open the flow control device 124 and the port closure sleeves 430, 432. In one or more embodiments, the sliding sleeve shifting tool 590 can be a collet, a magnetic actuator, another common down hole shifting tool, or combinations thereof. The interaction of the service string 500 and the completion string 400 is described in more detail in FIGS. 6-12.

Figure 6:
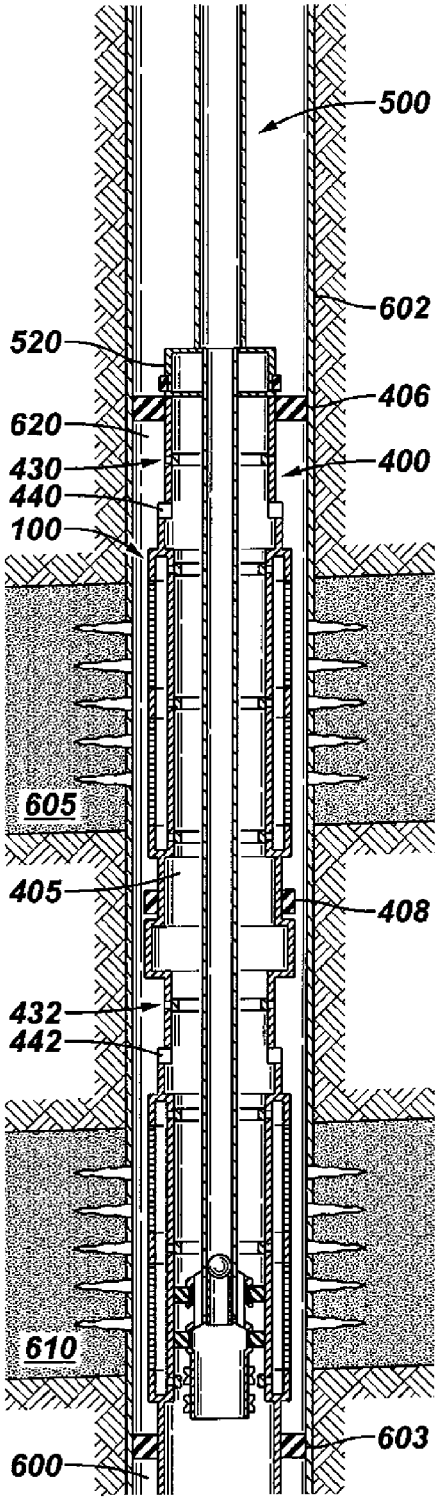
FIGS. 6-12 are schematics of the completion string of FIG. 3, and depict a sequential illustration thereof configured to perform a gravel pack operation on a wellbore, according to one or more embodiments described.

FIG. 6 depicts an embodiment of the completion string 400 configured to perform a gravel pack operation on a wellbore 600, according to one or more embodiments. The service string 500 can be positioned within the completion bore 405 of the completion string 400. When used with cased holes, perforating steps can be taken before the completion string 400 is run-in the wellbore 600, and the sump packer 603 can be set. In one or more embodiments, the perforation steps, the setting of the sump packer 603, and the placement of the completion string 400 into the wellbore can be performed in the same trip.

Figure 7:
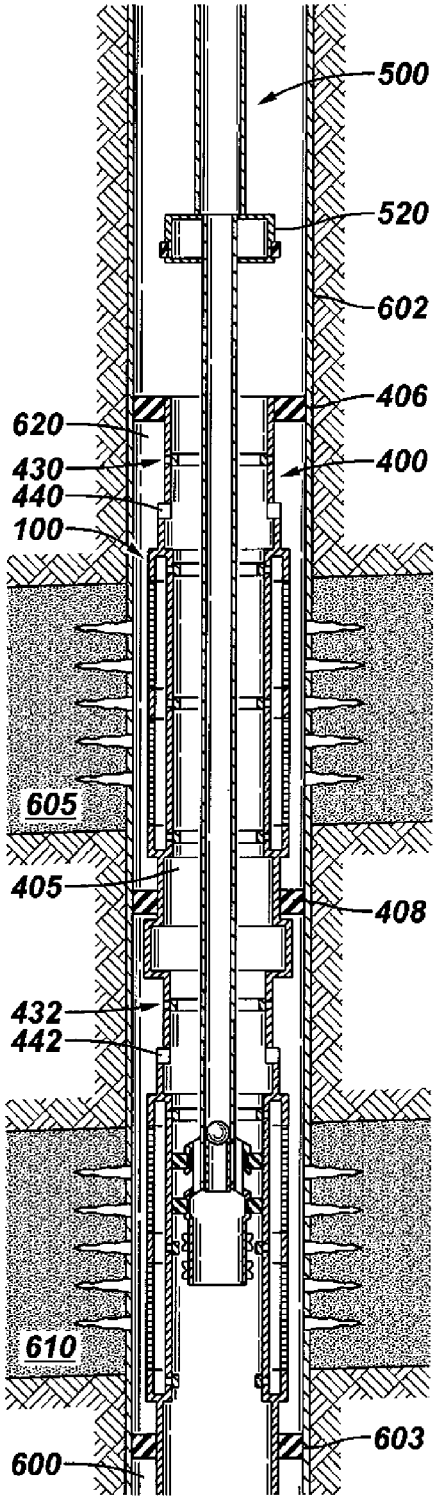

To run-in the completion string 400 the gravel pack setting module 520 can be secured or otherwise engaged with the first isolation packer 406, and the "upper" sand completion system 100 can be placed adjacent to hydrocarbon bearing zone 605, and the "lower" sand completion system 100 can be placed adjacent to the hydrocarbon bearing zone 610. The spacing of the sand completion systems 100 can be determined by logging information or other downhole measurements. An annulus 620 can be formed between the completion string 400 and the wall 602 of the borehole 600. Upon positioning of the sand completion systems 100, the first packer 406 can be set and the packer module 520 can be released from the first packer 406, as depicted in FIG. 6. As depicted in FIG. 7, the rest of the packers, such as second packer 408 can be set and possible tested. Of course, in one or more embodiments, each packer 406, 408 can be set before the packer module 520 is released from the first packer 406. In one or more embodiments, one or more packers can be tested before the packer module 520 is released from the first packer 406.

Figure 8:
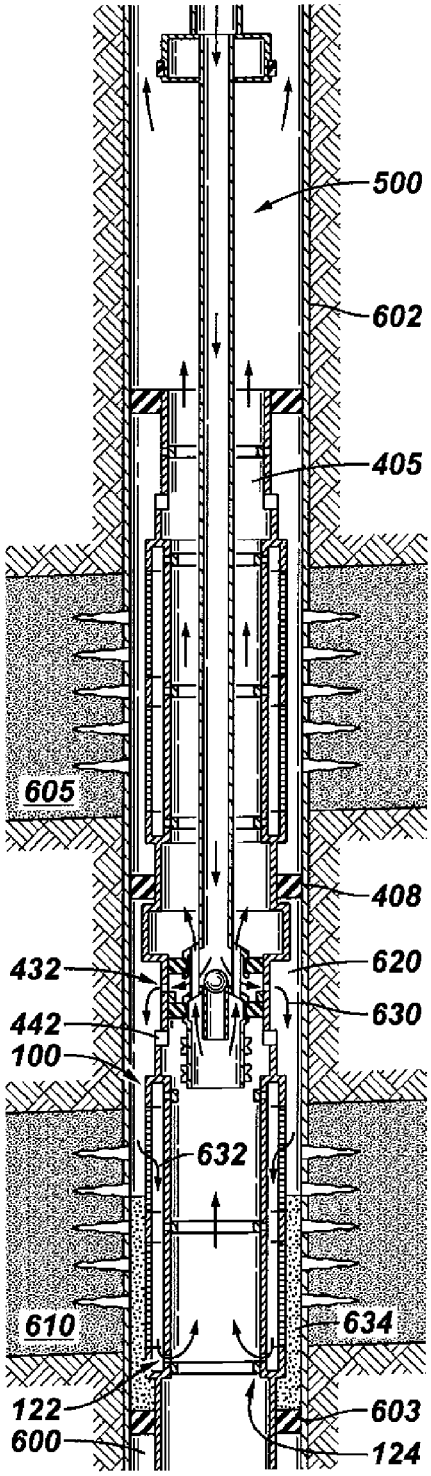
Figure 9:
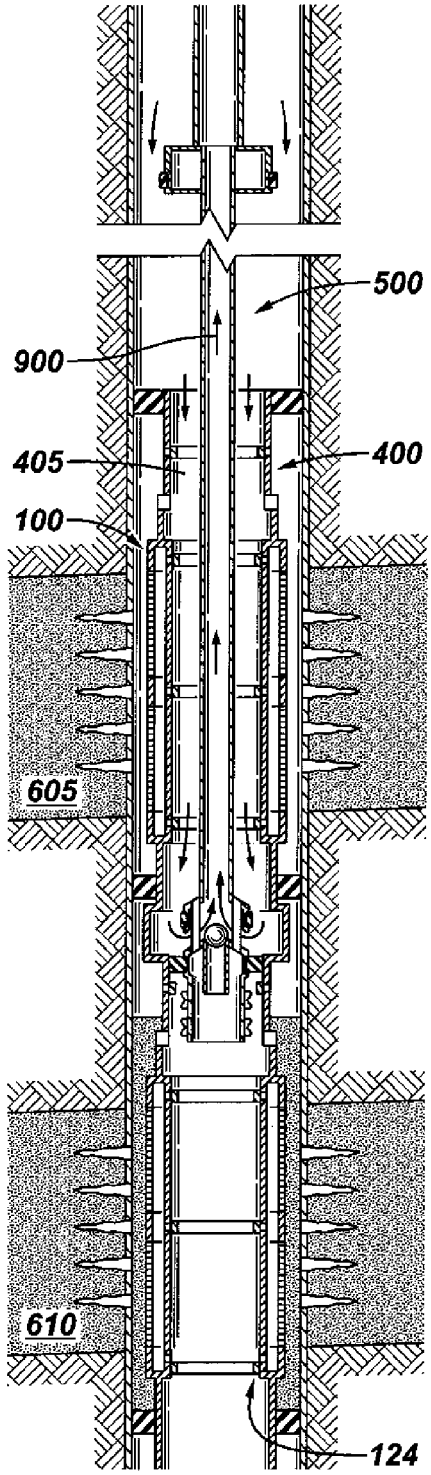

Turning now to FIG. 8, the service string 500 can be used to open at least the lower most flow control device 124 of the "lower" sand completion system 100, and the second port closure sleeve 432. The service string 500 can then be positioned to place gravel slurry 630 into the annulus 620 adjacent to the "lower" sand completion system 100. When the gravel slurry 630 is placed in the annulus 620, it is driven within the portion of the annulus 620 adjacent to the second hydrocarbon bearing zone 610, and dehydrates. As the gravel slurry 630 dehydrates a fluid portion 632, such as clean carrier fluid, can migrate through the first screen assembly 110 and the second screen assembly 112 of the "lower" sand completion system 100, and gravel 364 from the gravel slurry 630 can be held within the annulus 620 by the sand screen assemblies 110, 112 of the "lower" sand completion system 100. The fluid portion 632 can migrate flow thorough the flowpaths 114, 116, 118 of the "lower" sand completion system 100, and can flow through the opened flow control devices 124 into the completion bore 405 adjacent to the "lower" hydrocarbon bearing zone 610. Fluid can travel uphole as depicted by the arrows in FIG. 8. After the gravel 634 has formed a tight pack in the annulus 620, the placing of gravel slurry 630 can be stopped. The excess gravel slurry 900 can then be reversed out to the surface, as depicted in FIG. 9. After the excess slurry 900 is reversed out the service string 500 can close opened flow control devices 124 of the "lower" sand completion system 100 and the second port closure sleeve 432, thereby, isolating the "lower" hydrocarbon bearing zone 610.

Figure 10:
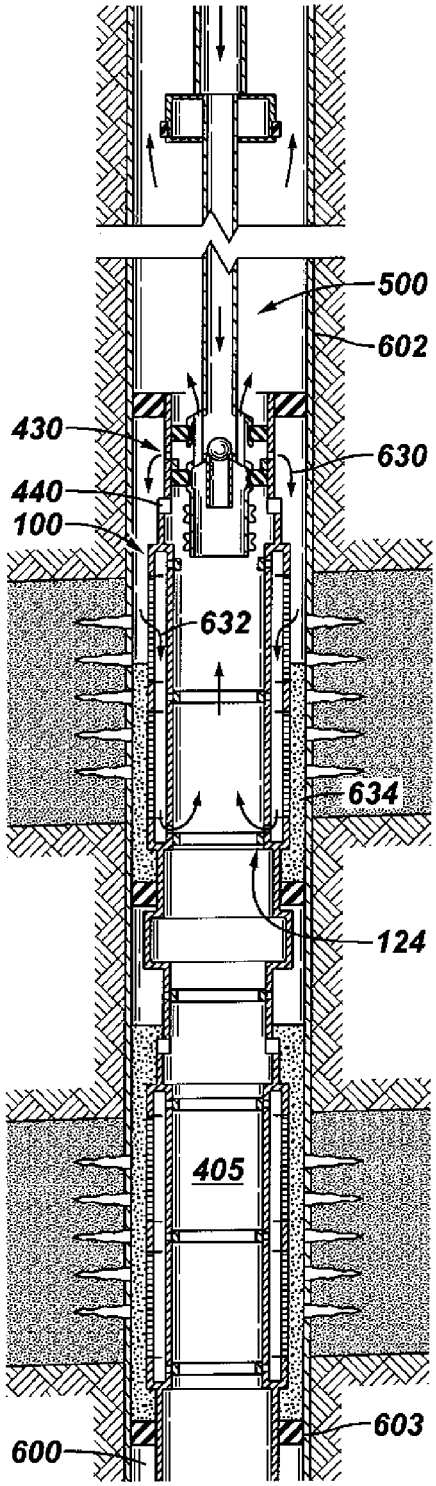
Figure 11:
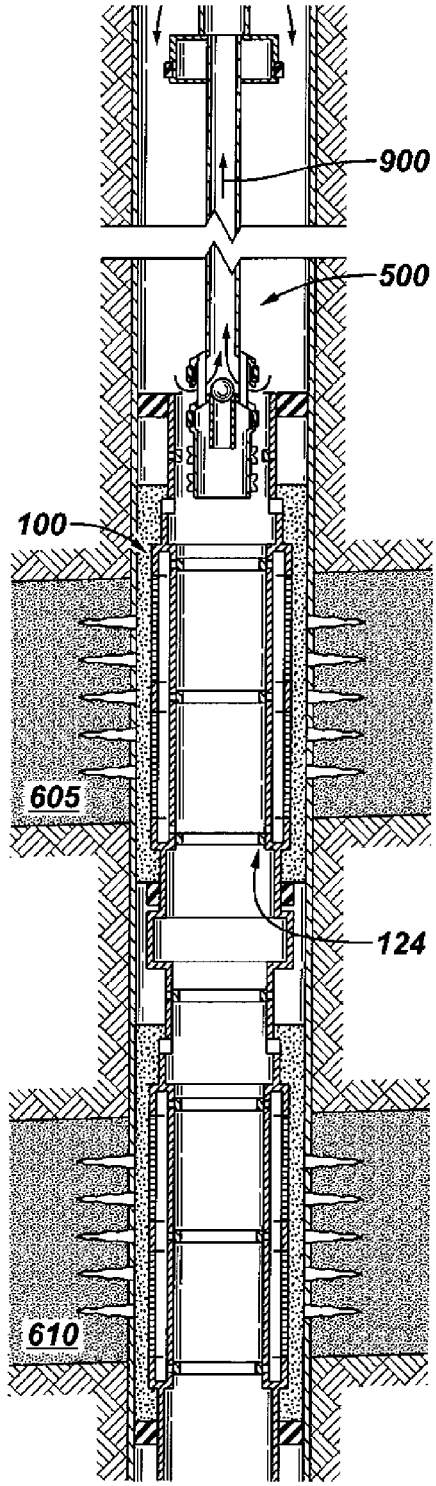
Figure 12:
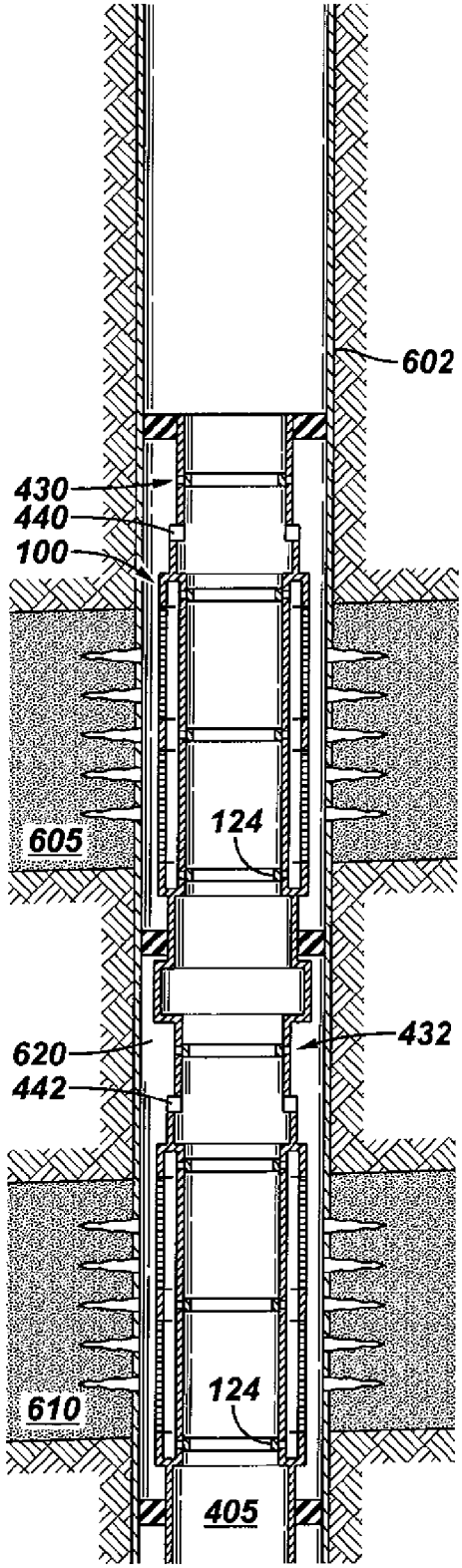

As depicted in FIG. 10, the service string 500 can actuate or "open" at least the lower flow control device 124 of the "upper" sand completion system 100 and the first port closure sleeve 430. Then the service string can be aligned with the port closure sleeve 430 using the position indicator 440. Gravel Slurry 630 can be pumped into the annulus 620 adjacent the "upper" hydrocarbon bearing zone 605. The gravel slurry can gather in the annulus 620. As the gravel slurry 620 dehydrates the fluid portion 632 can migrate through the sand screen assemblies 110, 112 and the flowpaths 114, 116, 118 of the "upper" sand completion system 100, and can flow through the opened flow control devices 124 into the completion bore 405 adjacent to the "upper" hydrocarbon bearing zone 605. The fluid portion 632 can travel uphole as depicted in FIG. 10, and the gravel 634 is held in place by the screen assemblies 110, 112. After the gravel pack is formed in the annulus 620 adjacent the "upper" hydrocarbon bearing zone 605, the excess slurry 900 can be reversed out as depicted in FIG. 11. After the reverse out operation the opened flow control devices 124 and the first port closure sleeve 430 can be closed completely isolating the annulus 620 adjacent to each hydrocarbon bearing zone 605, 610, and the service tool 500 can be removed, as depicted in FIG. 12. The above described actions can be performed for each hydrocarbon bearing zone intersected by the wellbore 600.

In one or more embodiments, when the upper completion is landed and the surface installations are ready for production, the flow control devices 124 can be selectively opened using slickline, wireline, coil tubing, or another conventional method to provide access to the hydrocarbon bearing zones 605, 610. In one or more embodiments, mechanical or magnetic interaction can be used to open the flow control devices 124.

In one or more embodiments, the flow control device 124 can be operated remotely. For example, pressure or a control conduit disposed adjacent to the completion 400 can be used to operate the flow control devices 124. The flow control devices 124 can also be operated remotely during the gravel pack operation as described in U.S. Pat. No. 6,446,729.

The present completion string and methods may be practiced in combination with one or more sets of components and/or service tools, including bridge plugs, flow valves, and other commonly used oil field tools. The term "attached" refers to both direct attachment and indirect attachment, such as when one or more tubulars or other downhole components are disposed between the "attached" components.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A sand screen assembly, comprising:

a first sand screen assembly comprising an imperforate base pipe and a screen, wherein the screen is disposed about the imperforate base pipe such that a first flowpath is defined therebetween;

a second sand screen assembly comprising an imperforate base pipe and a screen, wherein the screen is disposed about the imperforate base pipe such that a second flowpath is defined therebetween; and a coupling disposed between the first and second sand screen assemblies, wherein the coupling comprises:

a housing disposed between the imperforate base pipe of the first sand screen assembly and the imperforate base pipe of the second sand screen assembly, the housing defining a first coupling flowpath therein;

a shroud disposed at least partially about the housing forming a second coupling flowpath therebetween, wherein the shroud is disposed between the screen of the first sand screen assembly and the screen of the second sand screen assembly, wherein the second coupling flowpath is in fluid communication with the first and second flowpaths, and wherein the shroud comprises a blank pipe with a plurality of slots extending radially therethrough;

a third coupling flowpath formed through the housing and adapted to provide a path of fluid communication between the first and second coupling flowpaths; and a sliding sleeve disposed within the housing, wherein the sliding sleeve is configured to slide between a first position where the sliding sleeve substantially obstructs the third coupling flowpath and a second position where the third coupling flowpath is substantially free from obstruction, wherein the second coupling flowpath fluidly communicates with the first coupling flowpath via the third coupling flowpath when the sliding sleeve is in the second position.

2. The sand screen assembly of claim 1, wherein the first and second flowpaths and the second coupling flowpath are in fluid communication with an exterior of the sand screen assembly.

3. The sand screen assembly of claim 1, wherein an exterior of the sand screen assembly fluidly communicates with the second coupling flowpath via the plurality of slots.

4. The sand screen assembly of claim 1, further comprising:

a pipe joint connecting an end of the housing to the imperforate base pipe of the first sand screen assembly; and a torque shroud disposed about at least a portion of the pipe joint.

5. The sand screen assembly of claim 4, wherein the torque shroud is fixed to the pipe joint.

6. The sand screen assembly of claim 4, further comprising a load insert positioned adjacent to the torque shroud to support the sand screen assembly during make up operations, wherein the torque shroud is floating.

7. The sand screen assembly of claim 1, wherein the first flowpath is an unobstructed annular flowpath.

8. An apparatus for gravel packing a wellbore, comprising:

a first sand screen assembly having a first imperforate base pipe and a first sand screen disposed about the first imperforate base pipe;

a second sand screen assembly having a second imperforate base pipe and a second sand screen disposed about the second imperforate base pipe; and a coupling comprising:

a housing extending between the first and second imperforate base pipes and having a port extending radially therethrough;

a shroud disposed about at least a portion of the housing and extending between the first and second sand screens, wherein the shroud comprises a blank pipe with a plurality of slots extending radially therethrough; and a sliding sleeve disposed within the housing and configured to slide between a closed position in which the sliding sleeve substantially obstructs the port and an open position in which the port is substantially free from obstruction by the sliding sleeve.

9. The apparatus of claim 8, wherein:

the first sand screen assembly defines a first gap between the first imperforate base pipe and the first sand screen;

the second sand screen assembly defines a second gap between the second imperforate base pipe and the second sand screen; and the coupling defines a coupling gap between the housing and the shroud, wherein the first and second gaps fluidly communicate through the coupling gap.

10. The apparatus of claim 9, wherein the plurality of slots allows fluid communication between the coupling gap and an exterior of the apparatus.

11. The apparatus of claim 9, wherein:

when the sliding sleeve is in the open position, the coupling gap fluidly communicates with an interior bore of the housing via the port; and when the sliding sleeve is in the closed position, the sliding sleeve substantially prevents fluid communication through the port.

12. The apparatus of claim 8, further comprising first and second shoulders at least partially defined by an interior bore of the housing, wherein the sliding sleeve is configured to slide between the first and second shoulders.

13. The apparatus of claim 12, further comprising a shifting tool sized to slide within the first imperforate base pipe, the second imperforate base pipe, or both, and within the interior bore of the housing, wherein the shifting tool is configured to slide the sliding sleeve between the open and closed positions.

14. The apparatus of claim 8, further comprising:

at least one communication port positioned adjacent to at least one of the first and second sand screen assemblies; and at least one position indicator positioned adjacent to the at least one communication port.

15. The apparatus of claim 8, wherein a first flowpath is defined between the first imperforate base pipe and the first sand screen, and wherein the first flowpath is an unobstructed annular flowpath.

16. A method for gavel packing a well, comprising:

running a completion string into a wellbore, the completion string comprising:

a first sand screen assembly having a first imperforate base pipe and a first sand screen disposed about the first imperforate base pipe;

a second sand screen assembly having a second imperforate base pipe and a second sand screen disposed about the second imperforate base pipe; and a coupling comprising:

a housing extending between the first and second imperforate base pipes and having a port extending radially therethrough;

a shroud disposed about at least a portion of the housing and extending between the first and second sand screens, wherein the shroud comprises blank pipe with a plurality of slots extending radially therethrough; and a sliding sleeve disposed within the housing and configured to slide between a closed position in which the sliding sleeve substantially obstructs the port and an open position in which the port is substantially free from obstruction by the sliding sleeve; and flowing a treatment fluid comprising a gravel slurry into an annulus formed between the completion string and a wall of the wellbore.

17. The method of claim 16, wherein the gravel slurry comprises a carrier fluid, and further comprising flowing the carrier fluid from the gravel slurry in the annulus through at least one of the plurality of slots and into a coupling flowpath formed between the housing and the shroud.

18. The method of claim 16, wherein a first flowpath is defined between the first imperforate base pipe and the first sand screen, and wherein the first flowpath is an unobstructed annular flowpath.

19. An apparatus for gravel packing a wellbore, comprising:

a first sand screen assembly having a first imperforate base pipe and a first sand screen disposed about the first imperforate base pipe;

a second sand screen assembly having a second imperforate base pipe and a second sand screen disposed about the second imperforate base pipe; and a coupling comprising:

a housing extending between the first and second imperforate base pipes and having a port extending radially therethrough;

a blank pipe with a plurality of slots extending radially therethrough, and disposed about at least a portion of the housing and extending between the first and second sand screens; and a sliding sleeve disposed within the housing and configured to slide between a closed position in which the sliding sleeve substantially obstructs the port and an open position in which the port is substantially free from obstruction by the sliding sleeve.

20. The apparatus of claim 19, wherein:

the first imperforate base pipe and the first sand screen form a first flowpath therebetween, the second imperforate base pipe and the second sand screen form a second flowpath therebetween, and the housing and the blank pipe form a first coupling flowpath therebetween.

21. The apparatus of claim 20, wherein the housing forms a second coupling flowpath therein.

22. The apparatus of claim 21, wherein the first flowpath, the second flowpath, and the first coupling flowpath are in communication with the internal bore through the port.

* * * * *